United States Patent [19]

Woodcock

[11] 4,269,126

[45] May 26, 1981

[54] KNIFE BLOCK FOR A TUFTING MACHINE

[75] Inventor: Douglas G. Woodcock, Blackpool, England

[73] Assignee: Pickering Blackburn Limited, Lancashire, England

[21] Appl. No.: 52,322

[22] Filed: Jun. 26, 1979

[30] Foreign Application Priority Data

Jul. 13, 1978 [GB] United Kingdom ..... 29807/78

[51] Int. Cl.[3] ..... D05C 15/24

[52] U.S. Cl. ..... 112/79 R

[58] Field of Search ..... 112/79 R; 30/320, 335; 26/8 R, 9, 10

[56] References Cited

U.S. PATENT DOCUMENTS

| | | | |
|---|---|---|---|
| 2,143,678 | 1/1939 | Baggett et al. | 112/79 R |
| 3,488,843 | 1/1970 | Tims, Jr. | 30/162 |
| 3,757,709 | 9/1973 | Cobble | 112/79 R |
| 4,069,776 | 1/1978 | Cobble | 112/79 R |

FOREIGN PATENT DOCUMENTS

| | | | |
|---|---|---|---|
| 2755635 | 6/1978 | Fed. Rep. of Germany | 26/9 |

*Primary Examiner*—Robert Mackey

*Attorney, Agent, or Firm*—Watson, Cole, Grindle & Watson

[57] ABSTRACT

A knife block for a tufting machine producing cut pile fabric carries two identical knives disposed face to face, with one knife projecting from the block sufficiently to act as an operative knife and the other knife projecting to a lesser extent and acting solely as a back-up knife to support the operative knife against deflection.

2 Claims, 9 Drawing Figures

KNIFE BLOCK FOR A TUFTING MACHINE

A tufting machine for forming cut pile fabric includes a reciprocating needle bar, carrying needles which at each machine cycle project through a backing fabric a row of loops of yarn extending in a direction transverse to the direction of travel of the fabric, loopers which enter and retain the loops and knives mounted by knife blocks on an oscillating knife bar which cut the loops held on the loopers.

In the interests of economy in manufacture it is desirable to be able to use standard knives, irrespective of the gauge of the tufting machine, i.e. the spacing between the needles on the needle bar.

A standard knife block at present in use in tufting machines is shown in FIGS. 1 and 2 of the accompanying drawings, FIG. 1 being a perspective view and FIG. 2 a section on the line II—II in FIG. 1. As shown, the knife block in the form of a body member 10, which carries a peg 11 which fits into a hole in the knife bar, carries two knives 12, the edges of which are accommodated in slots 14 in the knife block and which are retained in position by clamping screws 13. The knives 12 are identical and their cutting ends 15 project from the block to the same extent. In operation, the knives serve to cut loops of yarn on two adjacent loopers.

When, however, such standard knife blocks are used on wide gauge machines which use relatively heavy yarns, it has been found that the knives do not cut the yarns satisfactorily because they tend to deflect over the yarns and away from the loopers.

With a view to overcoming this difficulty, the invention provides a knife block for a tufting machine producing cut pile fabric which includes slots accommodating the opposed edges of a pair of identical knives disposed face to face, one of the knives being an operative knife which projects from one side of the block to cutting position and the other knife projecting to a lesser extent from the same side of the block and acting solely as a back-up knife to support the operative knife against deflection when cutting a yarn, and means for clamping the knives in the slots.

Certain embodiments of knife block according to the invention are illustrated in FIGS. 3–9 of the accompanying drawings, in which.

Like reference numerals designate like parts in all figures of the drawings.

Figure 1:
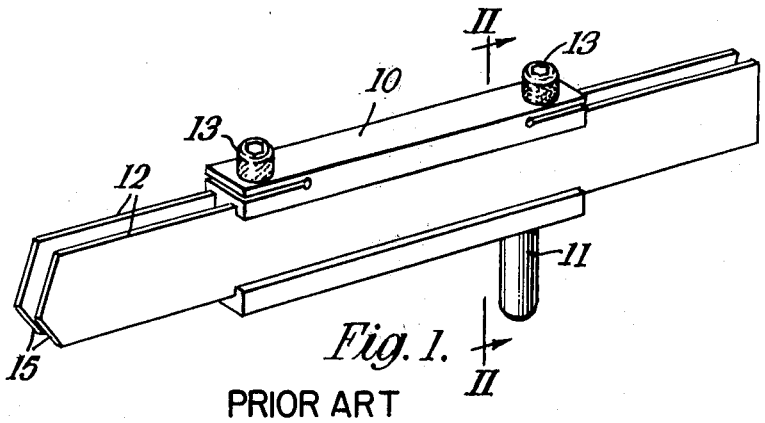
Fig. 1. PRIOR ART
Figure 2:
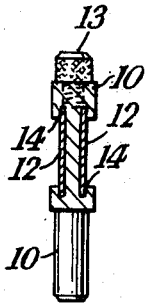
Fig. 2. PRIOR ART
Figure 3:
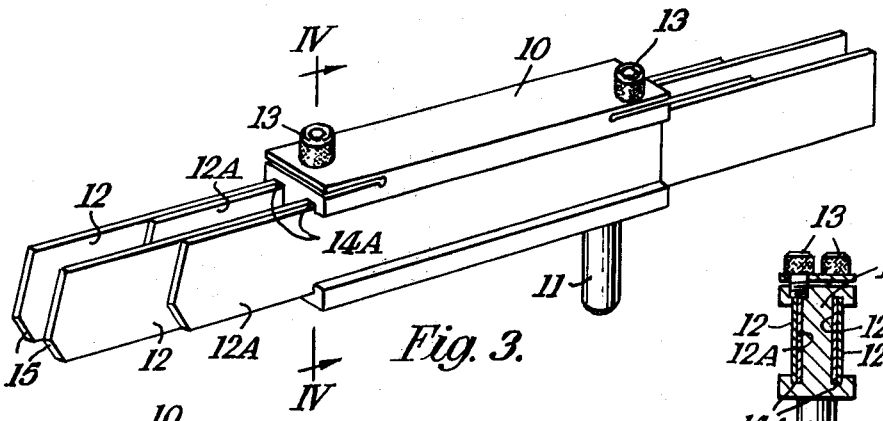
FIG. 3 is a perspective view of a first embodiment of knife block.
Figure 4:
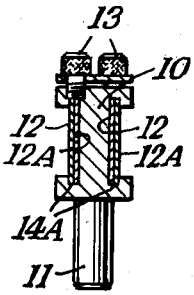
FIG. 4 is a section on the line IV—IV in FIG. 3.
Figure 5:
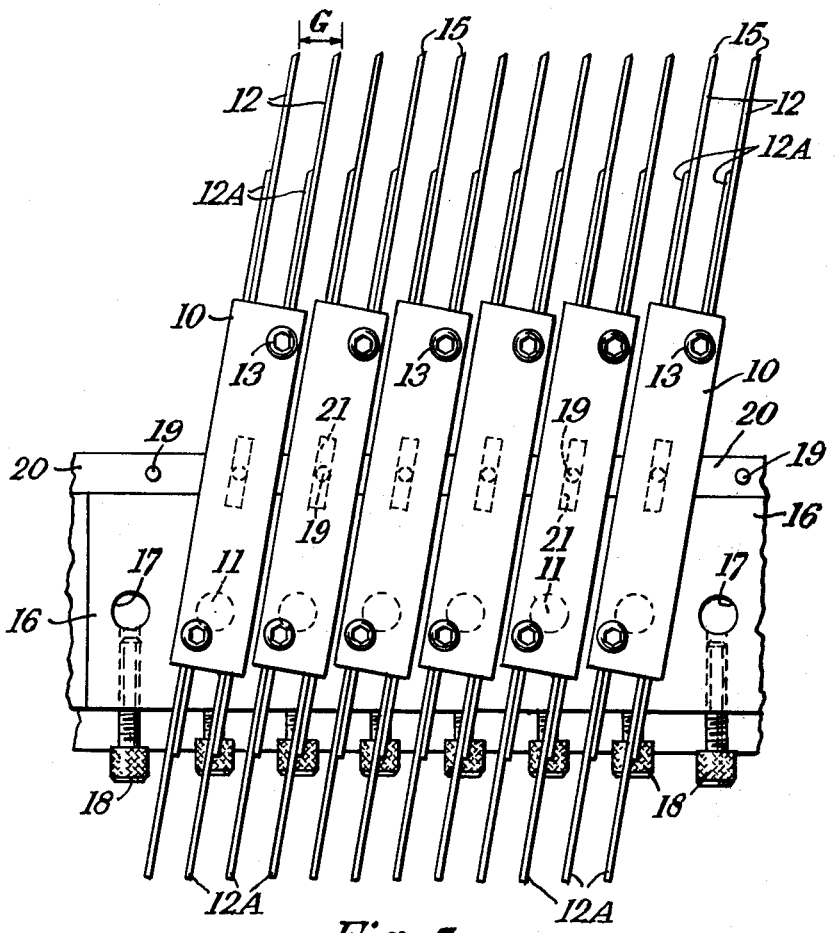
FIG. 5 is a front elevation showing a number of knife blocks as shown in FIG. 3 mounted side by side on a knife bar.

The knife block in the form of a body member 10, shown in FIGS. 3–5 is generally similar to that shown in FIGS. 1 and 2 but the slots 14A are wider than the slots 14 and each accommodates the edges of two identical standard knives 12, 12A disposed face to face. The clamping screws 13 are staggered and each serves to clamp one of these pairs of knives. The knives 12 project from the block 10 to the same extent as seen in FIG. 3, so that their cutting ends 15 are at the same level. The knives 12A project to a lesser extent and act solely as back-up knives to support the operative knives 12 against deflection away from the loopers when cutting the yarns.

FIG. 5 shows a number of knife blocks 10 of the construction shown in FIG. 3 mounted side by side on a knife bar 16 of the construction more fully described in U.S. Pat. No. 4,175,497 issued Nov. 27, 1979. The pegs 11 on the knife blocks are accommodated in holes 17 in the knife bar and are retained in position by clamping screws 18. The operative knives 12 are maintained at correct orientation with respect to the knife bar by engagement of pins 19 on a plate 20 attached to the knife bar with slots 21 in the bases of the knife block. The spacing of the cutting ends 15 of the knives 12 is equal to the machine gauge G.

Figure 7:
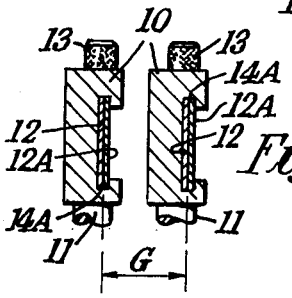
FIG. 7 is a section on the line VII—VII in FIG. 6 which also shows an adjacent knife block.
Figure 6:
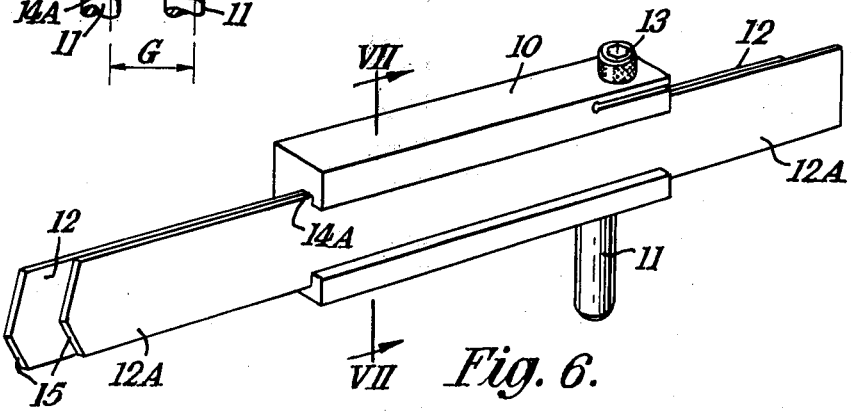
FIG. 6 is a perspective view of a second embodiment.

In wide gauge machines, in which more room is available, it is possible to use knife blocks 10 which, have a single pair of slots 14A, as shown in FIGS. 6 and 7, accommodating a single operative knife 12 and identical back-up knife 12A held in position by a single clamping screw 13. Two adjacent such knife blocks 10 are shown in FIG. 7.

Figure 8:
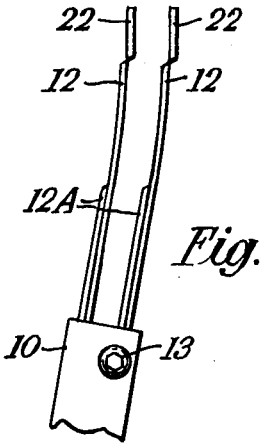
FIGS. 8 and 9 are explanatory diagrams.
Figure 9:
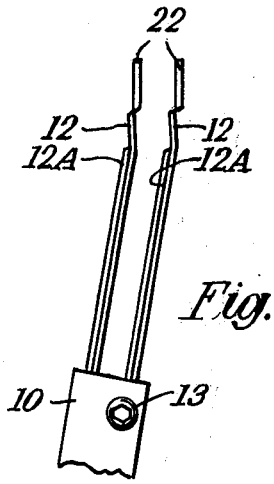

The tendency of the knives to deflect could, of course, be overcome by using thicker knives. The use of pairs of thinner standard knives has, however, the following advantages over this:

1. Standard components can be used and it is unnecessary to manufacture and stock thicker knives for use in circumstances when the thinner knives will deflect unduly.
2. The knives of each pair can be interchanged when the operative knives have become worn, so doubling the period before regrinding of the knives becomes necessary.
3. The extent of projection of the back-up knives 12A can be changed, as shown in FIGS. 8 and 9, in which the loopers are indicated at 22, to impart the desired cutting tension and rigidity to the operative knives 12. The two knives 12, 12A of each pair thus constitute in effect a variable leaf spring.

What I claim as my invention and desire to secure by Letters Patent is:

1. A knife block for a multi-needle tufting machine producing cut pile fabric, comprising a body member having a pair of opposed outwardly facing surfaces and at least one pair of opposed inwardly facing slots, a peg projecting from one of said outwardly facing surfaces for mounting said body member on a knife bar in the tufting machine, at least one pair of identical flat imperforate knives disposed in face-to-face contact in said body member with opposed edges of said knives received in said slots, one of said knives being an operative knife which projects from one side of said body member to cutting position and the other of said knives projecting from said one side of said body member to a lesser extent and acting solely as a back-up knife to support said operative knife against deflection when cutting a yarn, and at least one clamping screw mounted in said body member with an end of said screw engaging adjacent edges of both said knives to clamp said knives in said slots, whereby said back-up knife may be readily interchanged for said operative knife by unclamping and reclamping said screw when said operative knife becomes worn, and the extent of said back-up knife from said one side of said body member may be adjusted by unclamping and reclamping said screw for imparting the desired cutting tension and rigidity to said operative knife.

2. The knife block according to claim 1, wherein said body member has two pairs of said opposed inwardly facing slots, two pairs of said knives being disposed in said body member with opposed edges thereof respectively received in said two pairs of slots, a pair of said clamping screws respectively clamping said pairs of knives in said pairs of slots, and each of said knife pairs including said operative knife and said back-up knife.

* * * * *